US011501627B2

(12) United States Patent
Lazzi

(10) Patent No.: US 11,501,627 B2
(45) Date of Patent: Nov. 15, 2022

(54) SYSTEM TO PROMOTE PROPER HANDWASHING

(71) Applicant: Puriphico LLC, Pasedena, CA (US)

(72) Inventor: Adrian Lazzi, Pasadena, CA (US)

(73) Assignee: Puriphico LLC, Pasadena, CA (US)

( * ) Notice: Subject to any disclaimer, the term of this patent is extended or adjusted under 35 U.S.C. 154(b) by 0 days.

(21) Appl. No.: 17/328,946

(22) Filed: May 24, 2021

(65) Prior Publication Data

US 2021/0366265 A1 Nov. 25, 2021

Related U.S. Application Data

(60) Provisional application No. 63/028,947, filed on May 22, 2020.

(51) Int. Cl.
*G08B 21/00* (2006.01)
*G08B 21/24* (2006.01)

(52) U.S. Cl.
CPC ..... *G08B 21/245* (2013.01)

(58) Field of Classification Search
CPC ... G08B 21/245; G06K 9/00355; G06Q 30/01
See application file for complete search history.

(56) References Cited

U.S. PATENT DOCUMENTS

| | | | | |
|---|---|---|---|---|
| 6,882,278 | B2 | 4/2005 | Winings et al. | |
| 7,605,704 | B2 | 10/2009 | Munro et al. | |
| 8,368,544 | B2 | 2/2013 | Wildman et al. | |
| 10,332,382 | B2 | 6/2019 | Thyroff | |
| 2010/0073162 | A1* | 3/2010 | Johnson | G08B 21/245 340/540 |
| 2020/0074835 | A1* | 3/2020 | Waghode | G16H 40/63 |
| 2020/0074836 | A1* | 3/2020 | Kolavennu | G08B 21/245 |

* cited by examiner

*Primary Examiner* — An T Nguyen
(74) *Attorney, Agent, or Firm* — Alliance IP, LLC

(57) ABSTRACT

A system for identifying proper handwashing includes one or more sensors to monitor audio at a sink. The system for identifying proper handwashing further includes circuitry to receive sensor data from the one or more sensors, wherein the sensor data comprise audio data collected during functioning of the sink, detect that the audio data corresponds to one or more particular handwashing events in a set of handwashing events, and determine whether the particular handwashing event satisfies a condition associated with a standard for proper handwashing.

20 Claims, 13 Drawing Sheets

SYSTEM TO PROMOTE PROPER HANDWASHING

This application claims the benefit of priority to U.S. Provisional Patent Application Ser. No. 63/028,947, filed May 22, 2020, which is incorporated by reference herein in its entirety.

BACKGROUND

The present disclosure relates in general to the field of electronic monitoring, and more specifically, to computer-aided systems for monitoring handwashing behavior of humans.

Proper handwashing and hand hygiene has long been known to play a pivotal role in personal and public health. Despite the apparent simplicity of regular handwashing, inconsistent standards, lackadaisical individual habits, and insufficient public health education have resulted in ongoing issues in encouraging and facilitating proper handwashing among large segments of the world's population, in spite of efforts to simplify the act of hygienic handwashing through posted reminders, contactless soap and water dispensers, hand drying systems, and the like.

BRIEF SUMMARY

In some aspects of the present disclosure, a device or system is provided, which includes one or more sensors to monitor audio at a sink and circuitry to receive sensor data from the one or more sensors, wherein the sensor data includes audio data collected during functioning of the sink. The circuitry may further detect that the audio data corresponds to one or more particular handwashing events in a set of handwashing events and determine whether the particular handwashing event satisfies a condition associated with a standard for proper handwashing. One or more audible or visual alerts may be presented by the device, in some implementations, to indicate whether the handwashing was successful or not. Additionally, in some aspects, sensor data can include visual data and the audio data and visual data can be used together to determine a signature for the activity performed at the sink and determining whether the particular handwashing event satisfies a condition associated with a standard for proper handwashing based on the audio and visual data.

In another aspect of the present disclosure, proper handwashing may be determined by a computer-implemented process including receiving sensor data from one or more sensors monitoring audio at a sink, where the sensor data comprise audio data collected during functioning of the sink. It is determined or detected that the audio data corresponds to one or more particular handwashing events in a set of handwashing events. Further, it is determined whether the particular handwashing event satisfies a condition associated with a standard for proper handwashing. In some aspects, visual data collected from the one or more sensors may be combined and correlated to corresponding audio data to determine (based on the combined visual and audio sensors data) whether this combined data corresponds to one or more particular handwashing events in a set of handwashing events, among other embodiments and aspects such as described and illustrated herein.

BRIEF DESCRIPTION OF THE DRAWINGS

Like reference numbers and designations in the various drawings indicate like elements.

DETAILED DESCRIPTION

Figure 1:
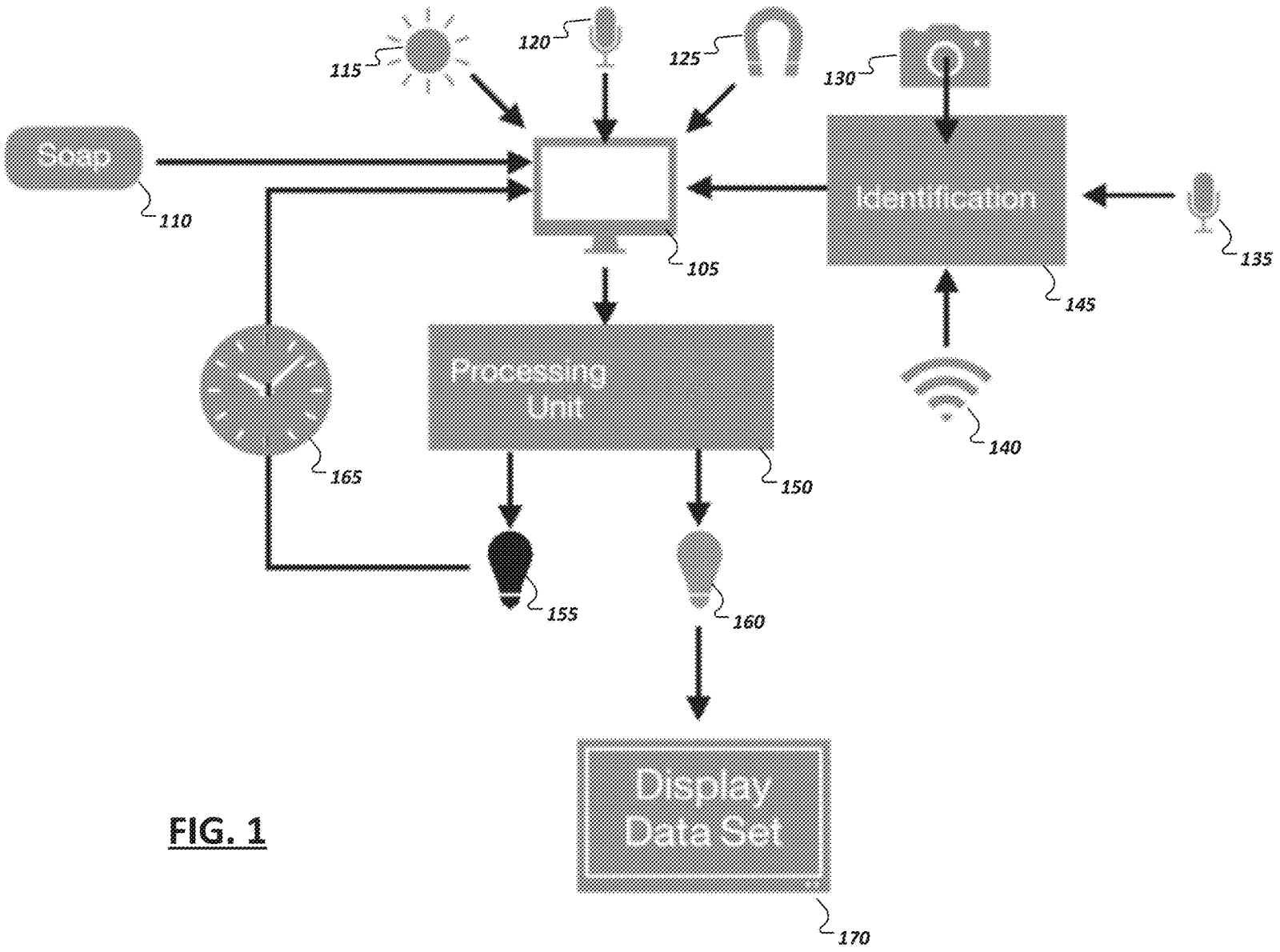
FIG. 1 is a simplified schematic diagram of an example system for identifying proper handwashing in accordance with at least one embodiment.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely in hardware, entirely in software (including firmware, resident software, micro-code, etc.) or combining software and hardware implementations that may all generally be referred to herein as a "circuit," "module," "device," "apparatus," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, CII, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the handwashing monitoring device, a supporting user computer (e.g., a laptop, smart home controller, smart phone, tablet, etc.), partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general-purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium (e.g., a non-transitory storage medium) produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In some implementations, a computer-implemented system may be provided with hardware circuitry and sensors to detect attributes of a user's attempt to wash their hands. The system may, based on the attributes, determine whether the handwashing was satisfactorily hygienic or not, for instance, based on sensing audio characteristics of the handwashing (e.g., via a microphone sensor and capturing a waveform representing the audio characterics) and determining that the nature and duration of the captured audio corresponds to what would be expected from a proper handwashing. The system may provide feedback to the user via one or a variety of different user interfaces to inform the user that the handwashing attempt was satisfactory or not, among other example features and functions, such as discussed in more detail below.

The CDC recommends at least 20 seconds of rubbing hands with soap under water in order to properly wash hands, thus eradicating harmful viruses and bacteria. Many, however well intentioned, neglect to observe the time requirement to properly wash their hands—that is, washing hands for less than 20 seconds is unfortunately too common of an occurrence. The consequences of this frequent, inadvertent or negligent mistake can be devastating to the community through the spread of harmful pathogens. Recent evidence suggests that the problem is not exclusively a problem of the general population; rather, personnel that is required to properly sanitize their hands (e.g., doctors, nurses, food service workers, etc.), often make a similar error unintentionally.

In some implementations, handwashing effectiveness can be significantly improved through the use of a system that encourages and aids the user in washing their hands for the sufficient amount of time, bearing significant potential to considerably reduce the diffusion of harmful bacteria within a community. In one example, an improved system may be provided that monitors whether or not a person has washed their hands for at least 20 seconds, and informs the person (e.g., through the use of visual (e.g., LED) and/or audio cues on the monitoring system) to increase compliance with the preferable 20-second minimum.

Other systems have been developed, which attempt to resolve inconsistency in the quality of handwashing habits. However, such traditional systems rely on features such as: (1) the use of infrared sensor to detect "handwashing motion"; (2) the use of smart badges (e.g., RFID) configured to transmit the identity of the person washing hands; (3) manual activation of a timer; or (4) the use of "smart buttons" (colored) installed on the person to identify him/her as someone that has properly washed hands, among other examples. Such traditional systems and these features have significant shortcomings. As an example, it is unlikely that a PIR (Proximal Infra-Red) sensor, by itself, can detect a specific handwashing motion. The PIR sensor can detect the presence of a person and movement, but cannot distinguish as to whether hands (or other body parts in front of the sink) are in motion or, worse, whether the hands are, in fact, under running water, among other example deficiencies. Solutions relying on extraneous devices, such as smart badges or buttons, unnecessarily limit the usability of a handwashing monitoring solution to only those users assigned (and remembering to carry) such devices and may even incentivize users not to wash their hands (e.g., if they have forgotten their badge), among other example disadvantages. The improved system discussed herein may utilize multiple sensing capabilities to resolve these and other deficiencies in prior solutions and provide a more reliable and accurate solution to the monitoring of handwashing time for compliance purposes, among other example advantages.

In one example implementation, an improved system for identifying proper handwashing utilizes a PIR sensor to detect the presence of a person in front of a sink or with one or more of their hands positioned in or near the sink; the proximity of a person activates a timer, a flashing red LED, and a miniature microphone (and potentially other additional sensors) installed in the system that records the sound directly in front of the sink (triggered by detecting presence of the person using the PIR sensor). The sound recording may be analyzed by the system for an intensity and/or frequency signature of the sound of running water while the user is at the sink. The intensity and/or frequency signature of the sound of running water (when no hands interrupt its flow from the faucet to the sink basin) is markedly different from the intensity and/or frequency signature of the sound of hands being rubbed under water, which is also likely different from the intensity and/or frequency signature of hands with soap being rubbed under water (to rinse off the soap) or of hands with soap being rubber outside of water (prior to the rinsing). In some implementations, additional sensors may capture non-sound information (e.g., proximity information, motion information, visual images, etc.), which may be aligned temporally with the captured audio information to form a signature for the activity at the sink as captured by the combination of audio and non-audio sensors. This signature may be compared with reference (audio plus non-audio) signatures defined for the various steps in a handwashing process to determine (based on the combined audio and non-audio data) whether the monitored activity is sufficiently similar to the reference and corresponds to completion of the corresponding handwashing step. Accordingly, each of these distinct and important steps in the handwashing process may be autonomously identified and monitored using the improved system to determine the occurrence of the proper handwashing steps (e.g., according to a defined standard or preferred process) to determine when a user has effectively washed their hands.

Figure 3A:
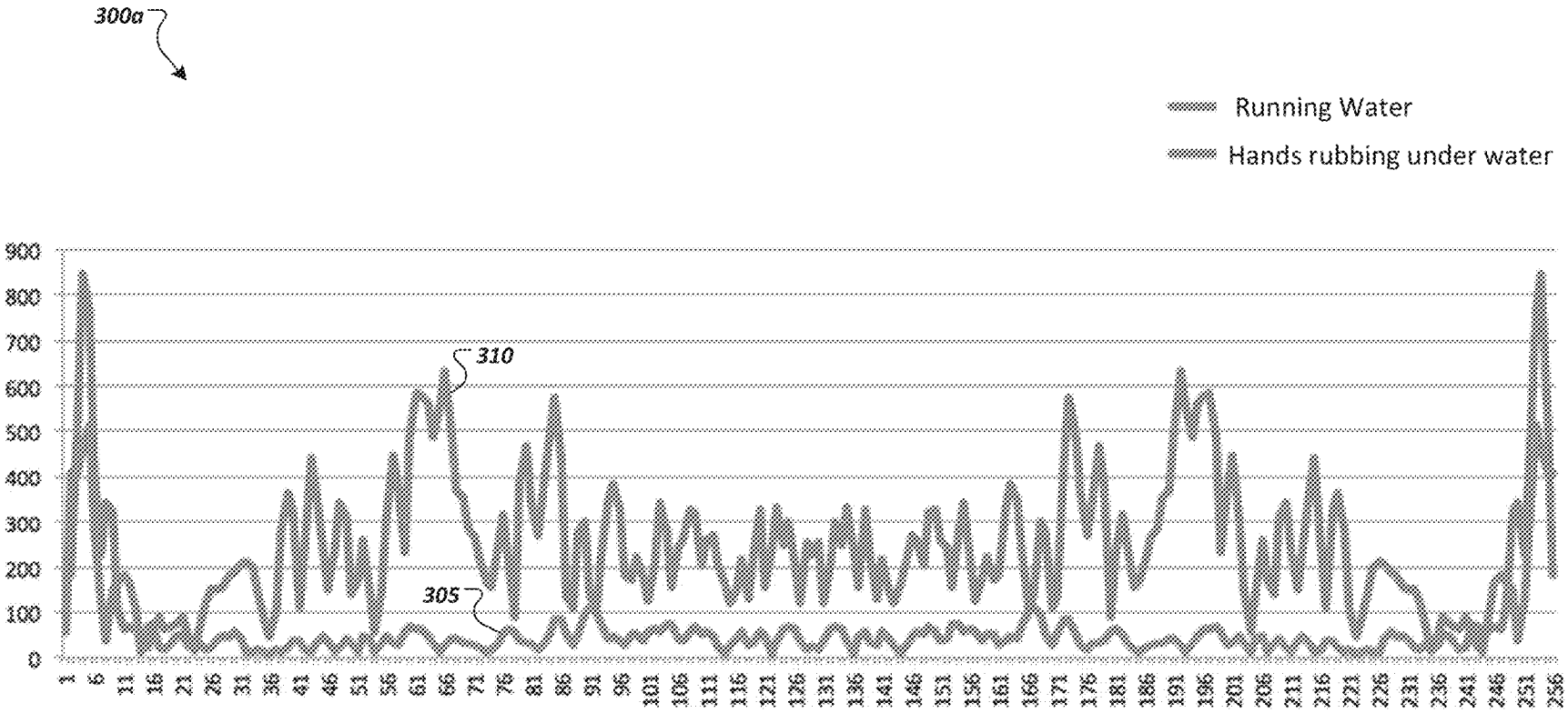
FIGS. 3A-3C are graphs showing example waveforms which may be generated and analyzed by an example system for identifying proper handwashing in accordance with at least one embodiment.
Figure 3B:
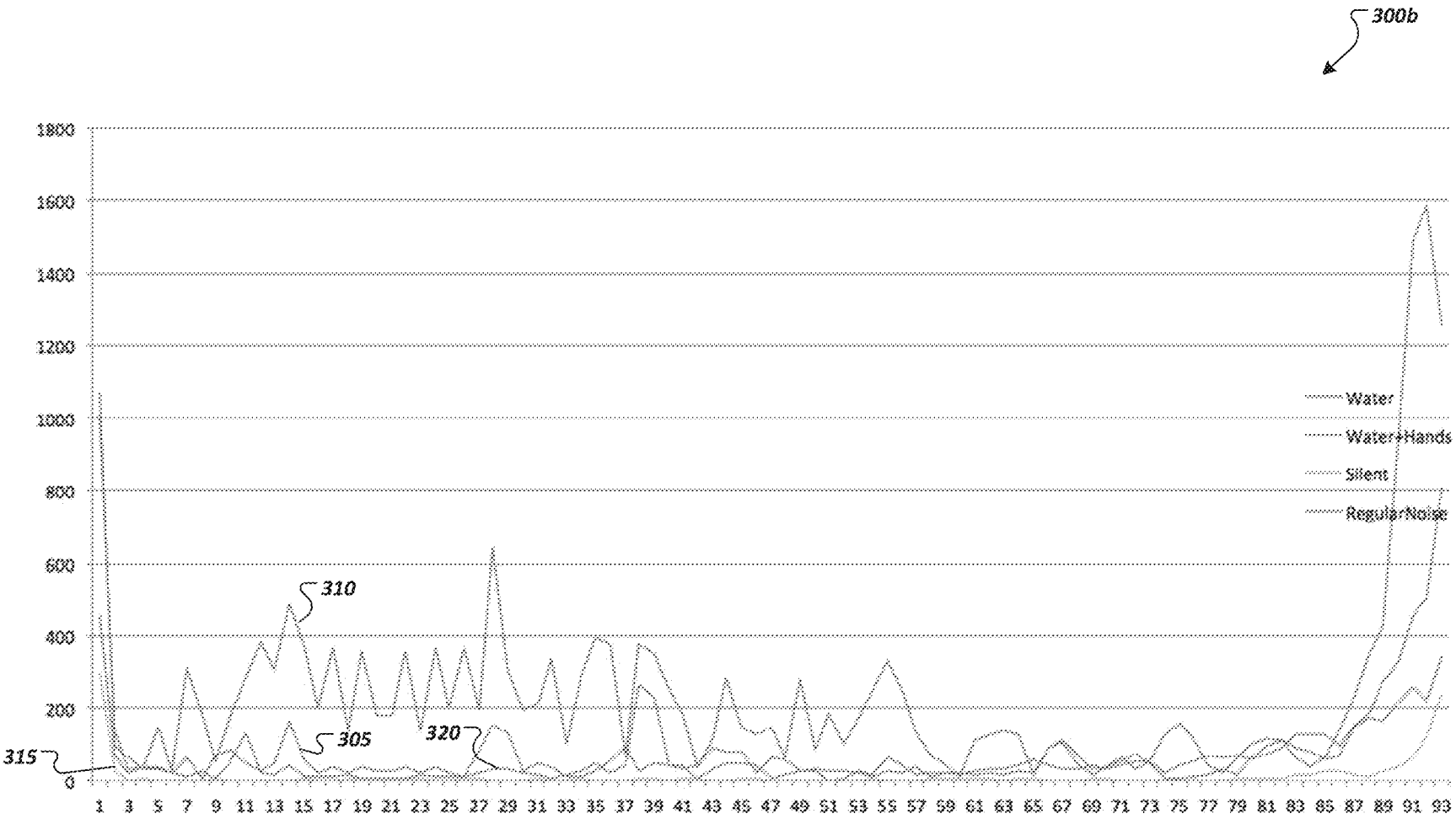
Figure 3C:
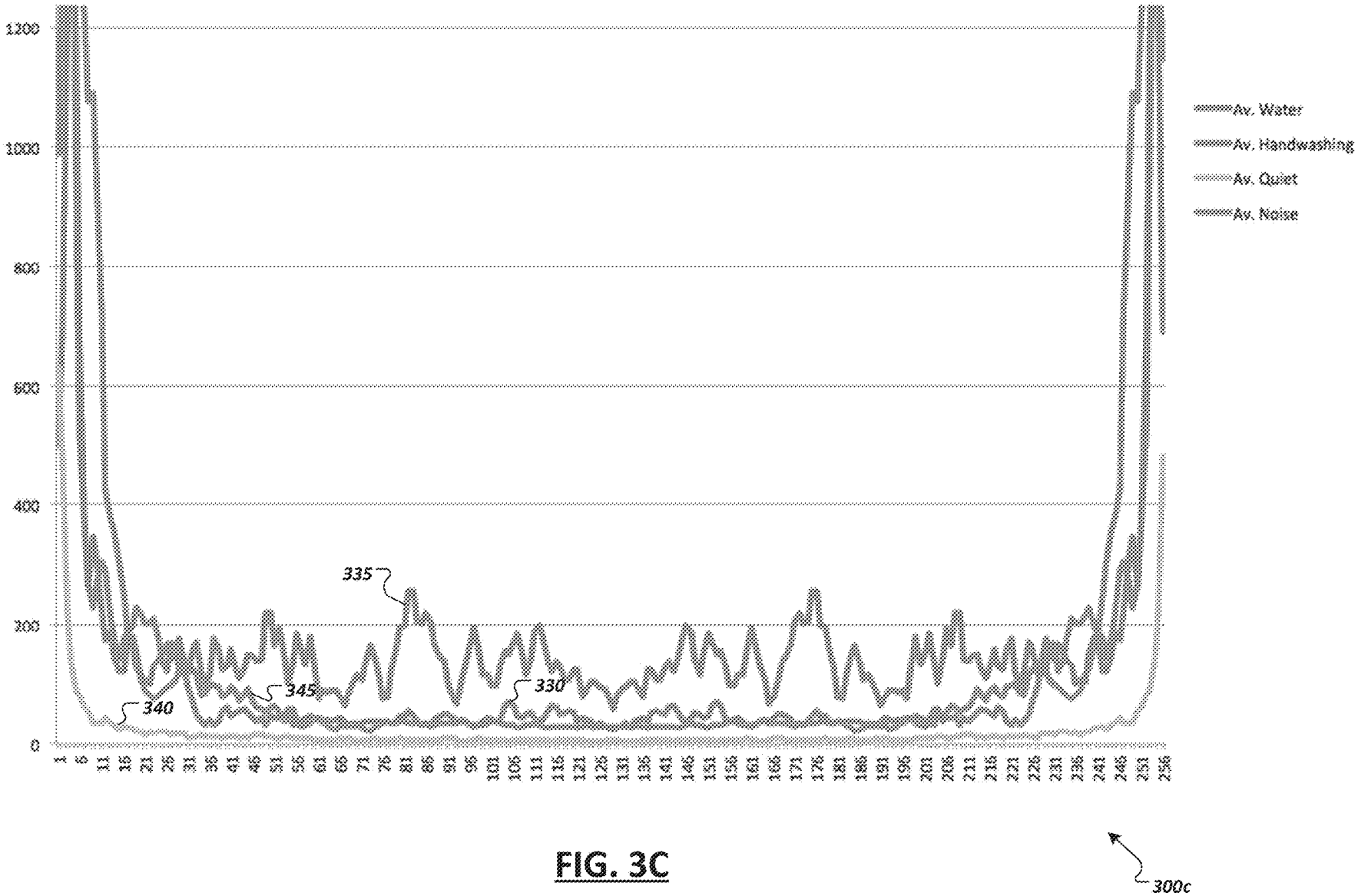

In some implementations, the amplitude of the different frequencies comprising the noise of the water and hand rubbing (that is, 'frequency signature' recorded by the microphone) can be detected using a Fourier Transform in some implementations. This signal can be processed using algorithms such as the Discrete Fourier transform (DFT) or the Fast Fourier Transform (FFT) by the same microprocessor controlling the various other sensors in the system. The frequency signature may depend on the individual sink due to various distinct aspects of the design, including faucet distance from the drain or the material of the sink itself. Accordingly, in some implementations, an initial calibration of the system may be performed to record and store the frequency signature of the noise of water flow for that particular sink (e.g., the frequency/amplitude signature corresponding to water running into the particular sink without impeding hand-rubbing) upon installation or can, alternatively, be stored in the memory of the processing unit for a database of known sinks, sink manufacturers, and distances between the faucet and the bottom of the sink. For instance, FIGS. 3A-3C show example waveforms for example sinks corresponding to different activities (e.g., uninterrupted running water vs. water running over hands vs. the sound in the ambient environment when no water is running, etc.). Similar reference data (e.g., proximity reader readings, reference video or images, etc.) may be pre-determined for various sinks and handwashing activities and used as reference data for comparison against corresponding non-audio sensor data captured by an example system for identifying proper handwashing events using the system, among other example features.

In some implementations, other additional or alternative attributes of handwashing activity may be monitored and utilized by an example system for identifying proper handwashing to determine the occurrence of a proper handwashing session. For instance, electrical capacitance is affected by the proximity of other objects. Accordingly, the system may include the installation of a rim on the faucet to be used to measure the electrical capacitance or inductance to detect events at the sink. For instance, the placement or continued presence of hands below a faucet may distort the fields in proximity of the rim, thus affecting the capacitance or inductance measured in what is detected as a change of impedance. This means that a proper detection system cannot simply rely on movement in front of a sink. Unlike traditional systems, an improved system for identifying proper handwashing may couple multiple signatures (e.g., movement, frequency of sound, capacitive/inductive coupling) detected through a set of various sensors present on the system for identifying proper handwashing to ensure that hand rubbing is performed properly, that soap is used, that a rinse event follows a soap event, and that one or more of these events is performed for a threshold amount of time.

In some implementations, the sensors utilized by an example system for identifying proper handwashing to detect handwashing events may all be collocated on a single device (e.g., on which the data processor and corresponding executable logic is stored). In other instances, the system for identifying proper handwashing may communicate with other sensor devices separate from the system to build the set of signatures for detecting proper handwashing. As an example, sensors may be provided which are connected to soap dispensers throughout the lavatory, which can communicate to the processing unit in the effort of determining whether proper handwashing techniques had been implemented with soap applied. Coaction between the various sensors will minimize false positives and false negatives collected in the data set: a running combined 'detection score' may be adjourned (in real time) as the person washes his/her hands. A true positive, well executed, handwashing will result in a combined 'detection score' above a preset value, corresponding to positive identification of the action of handwashing and the accompanying sound of the user rubbing soapy hands under water.

In some implementations, an example system for identifying proper handwashing may include sensors for detecting particular users (e.g., for whom handwashing compliance is a particular important or sensitive matter) and may record the successful completion of handwashing events occurring at a particular sink. For instance, a microcamera or barcode-reader may be installed in an example system in some implementations, and the camera or reader may read a colored tag or a "barcode"-like tag on the uniform of specific personnel (e.g., chefs, doctors) to be able to collect data sets regarding the compliance of specific professions within an institution. Other methods, such as facial recognition and vocal self-identification prior to washing one's hands (in which the user states their name) can also be implemented; for example, outside the lavatory unit could be a facial recognition system by which to identify the staff entering: once the staff member has declared his/her name and completed the requisite duration of proper handwashing (e.g., 20 seconds), their name would be approved—otherwise a list of users practicing improper handwashing techniques could be collected depending on the enforcer of the institution (e.g., and transmitted via a wireless communication channel to a server storing records of proper and improper handwashing events, habits, cleanliness standards, etc.), among other example features.

FIG. 1 is a schematic diagram illustrating an example implementation of an improved system for identifying proper handwashing. For instance, data collection logic 105 (e.g., implemented in hardware and/or software) may interface with multiple different sensors (e.g., 110, 115, 120, 125, 130, 135, 140, etc.) to generate a sensor data for processing and analytics using a data processing unit 150. Sensors may include light sensors (e.g., IR light, PIR, etc.), audio sensors 120, capacitance or inductance sensors 125 positioned at or toward a sink to monitor activity at the sink level. In some implementations, the system may include or communicate (e.g., wirelessly) with other sensors, such as a sensor 110 monitoring use of a soap dispenser, a door sensor to identify that a person has entered a lavatory containing the monitored sink, a toilet sensor (e.g., to identify a flush or other use of a toilet), among other examples. Sensors may also include sensors for use in identifying a user, such that successful or unsuccessful washing may be attributed to a user or team, such a camera sensor 130, voice sensors 135, electronic identification readers 140 (e.g., to read a smart badge using RFID or near field communication, etc.), among other examples. In some implementations, a system may include identification logic 145 utilizing data generated by one or more of sensors 130, 140, 145 (e.g., using sensor fusion) to detect the identity of a user, among other examples. Sensor data describing a handwashing event may be passed to the processing unit 150 to determine whether a sequence of handwashing events were successfully performed. In some implementations, a clock circuit or other timer (e.g., 165) may be utilized by the processing unit 150 to determine whether a given handwashing step was performed for a requisite or recommended amount of time. The processing unit 150 may detect such events and provide feedback to the user/handwasher via one or more user interfaces such as status lights 155, 160, a graphical user interface 170, audio queues (e.g., through one or more speakers), among other examples. The system may additionally include capabilities to wireless transmit report data to other computing systems (e.g., in a network) identifying successful and/or unsuccessful handwashing events corresponding to a particular sink or facility, among other example components. Indeed, it should be appreciated that implementations may include all or a subset of the components illustrated in FIG. 1 and still successfully perform the solutions described herein. Further, other sensors and logic blocks may be incorporated to further enhance the solution and the depth of the sensor data utilized by the processing unit without departing from the scope of this disclosure.

As discussed above, an example system for identifying proper handwashing may include multiple sensors communicatively coupled to a processing unit that determines whether the input signals collected by each sensor correspond to a user washing his/her hands. In one example, in the case of an affirmative result, a red light will flash and a timer will start. After 20 seconds (one flash per second) of uninterrupted handwashing, a green light will flash 3 times to alert the user that they have finished, among other examples. Indeed, a wide variety of visual and/or audio prompts may be generated by the system to assist users in performing proper handwashing and provide feedback as to the result. In some instances, either the incomplete handwashing period without a green light or the flashing green light of a complete session will feed the identification unit, which can scan the pre-collected information provided by the specific industry or home (such as business, education institution, hospital, private residences, etc.) to match a user's identity or specific protocols of the institution. Identification, as specified earlier, can be in the form of facial recognition, RFID worn by the person that washed his/her hands, barcode on a uniform, or the person announcing his/her name before starting to wash his/her hands. Finally, a customizable data set may be generated and presented to display the percentage of people who washed their hands properly for 20 seconds along with other information unique to the specific system deployment (or network of system deployments for which data may be retrieved and processed using a centralized system, among other example implementations).

Figure 2:
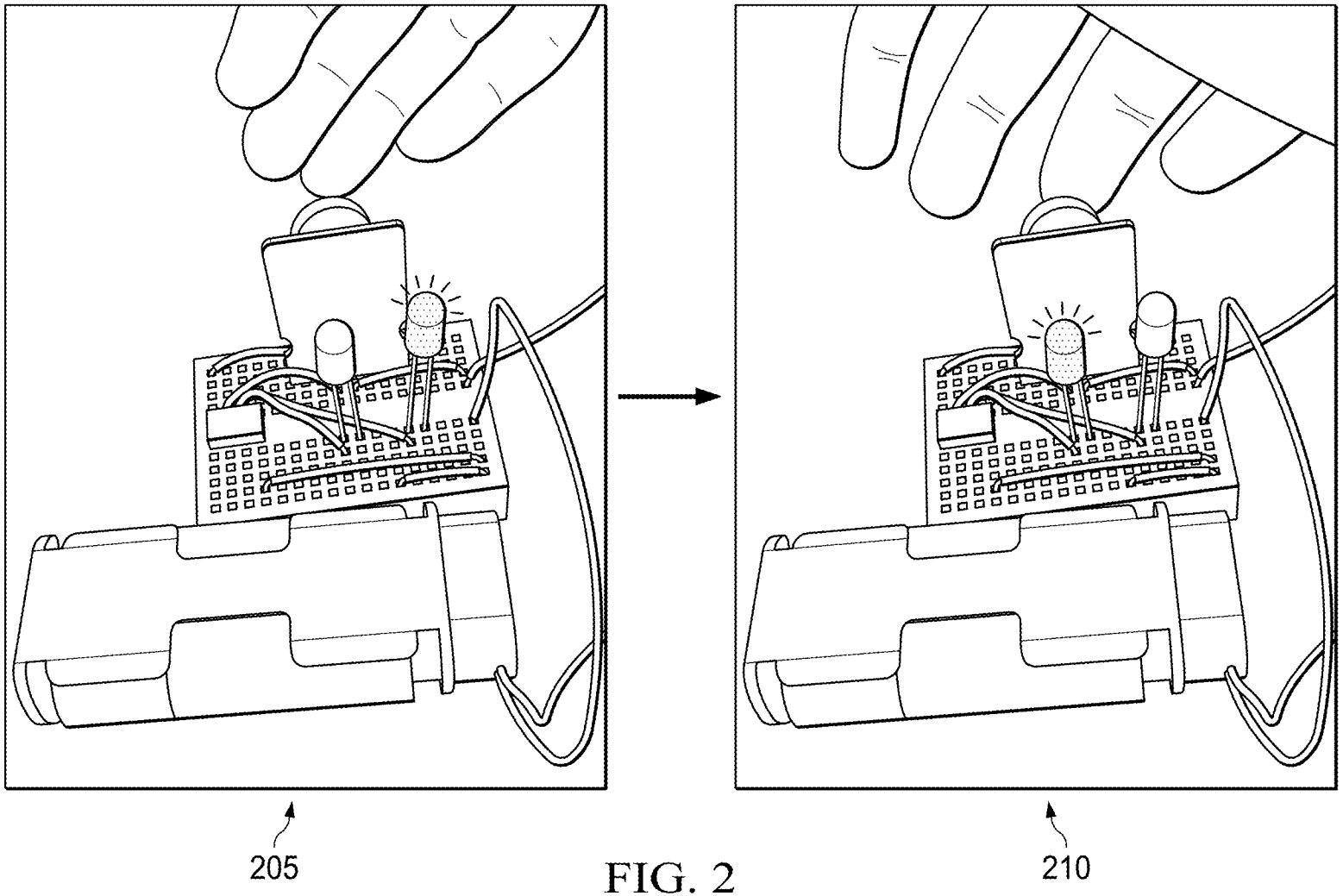
FIG. 2 are photographs showing operation of an example system for identifying proper handwashing in accordance with at least one embodiment.

FIG. 2 illustrates a compacted version of a first example prototype, lacking LCD display of a more sophisticated data set and microphone embedded system (as may be included in commercial embodiments of the solution). As shown in the photograph 205, in some implementations, a particular visual indicator (e.g., a red light) may be triggered when a user is detected at a sink and/or as the user begins an attempted handwashing. After detecting successful completion of a timed (e.g., 20 seconds) handwashing sequence using various sensors (e.g., motion detection), the red light may stop flashing as a green light (in photograph 210) begins flashing to indicate to the user that they have washed their hands sufficiently.

As discussed herein, in some implementations, a system for identifying proper handwashing may monitor audio patterns and signatures involving a sink to detect the actions, progress, and duration of a handwashing attempt. A microphone may generate corresponding waveforms, which may be analyzed by a data processing unit to determine that particular handwashing events are taking (or have taken) place. FIGS. 3A-3C are graphs 300*a-c* depicting example outputs of a Fast Fourier Transform (FFT) circuit upon waveform or audio data generated by an example microphone of an example system for identifying proper handwashing. Such waveforms or FFT results may be generated or used to describe a particular event captured at the sink and as references of characteristic sound signatures of various handwashing activities (e.g., with different unique signatures for water running without interference, water passing over the hands of a user within the sink, hands rubbing or lathering soap, etc.) to compare to captured data and detect a particular handwashing activity or event. For instance, FIG. 3A shows a graph 300*a* with a first FFT output 305 generated from an audio recording of running water at a sink and second FFT output 310 generated from an audio recording of hands running under water in the same sink. FIG. 3B shows a graph 300*b* showing FFT outputs of audio recordings of additional events, including the running water 305 and water passing over hands 310, but also silence 315 and ambient noise 320 to show the distinctiveness between these various conditions. In some implementations, a system for identifying proper handwashing may be trained by recording the audio of multiple instances of each of multiple events (e.g., no water running (or ambient noise), water running without interference, water running while hands are positioned motionless under the water, water running while hands are moving (rubbing) under the water, water running while hands are lathering outside the water, hands lathering while the water is turned off momentarily, etc.) to generate reference signatures for each of these multiple events from the average or otherwise aggregation of the multiple recordings of each activity. For instance, FIG. 3C is a graph showing example average FFT outputs from multiple audio recordings captured for uninterrupted running water 330, handwashing 335, silence 340, and ambient noise 345. Similar reference signatures may be developed by training other sensors (e.g., proximity, video, image, etc.) of the system for each of the designated handwashing steps. Indeed, sensor fusion may be utilized to develop signatures from the combined audio and non-audio readings corresponding to various handwashing events to improve the quality of the system's determinations and/or to provide redundancy in the case of a failed sensor, among other example benefits.

Figure 4A:
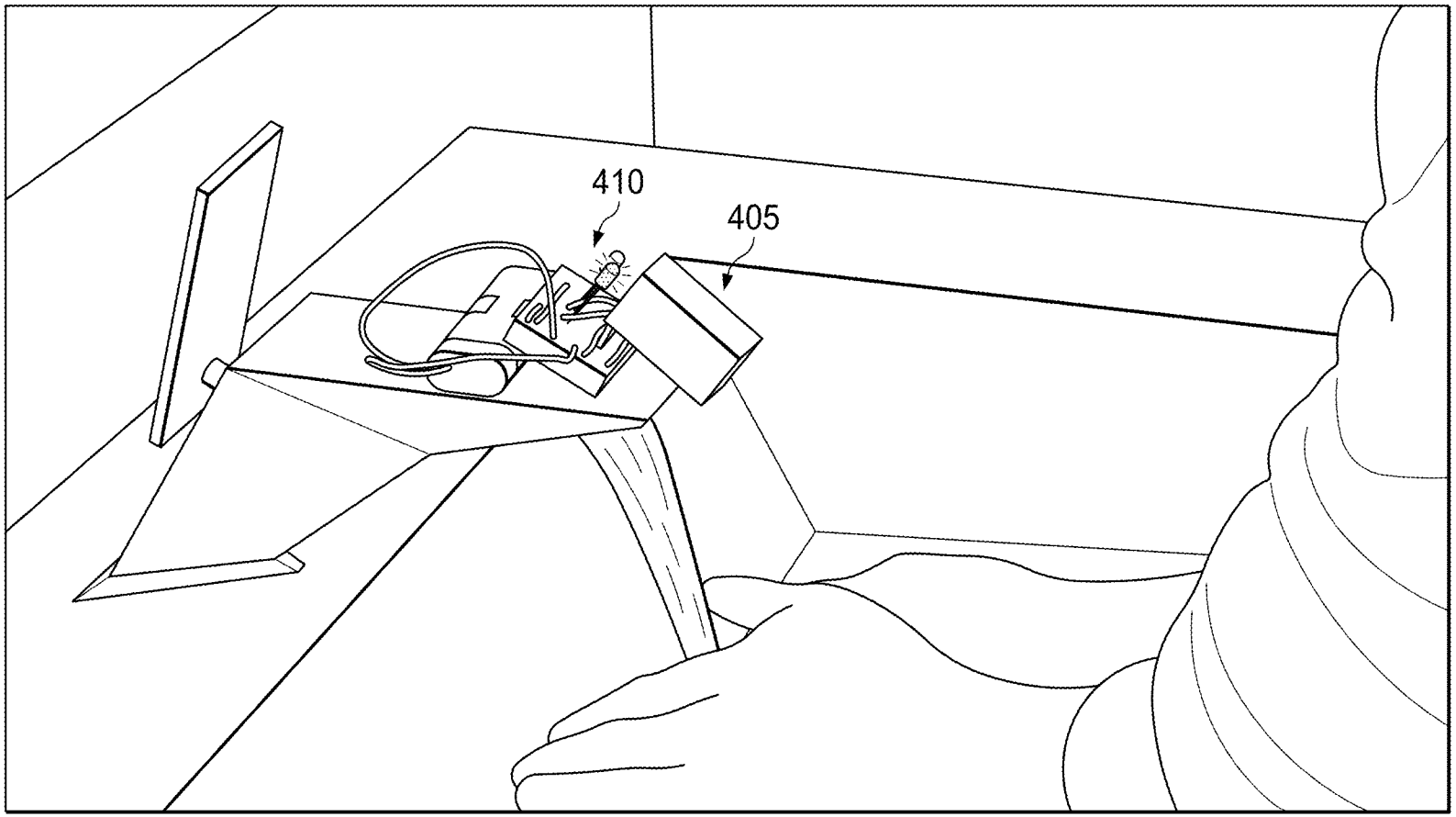
FIGS. 4A-4B are photographs showing use of an example system for identifying proper handwashing in accordance with at least one embodiment.
Figure 4B:
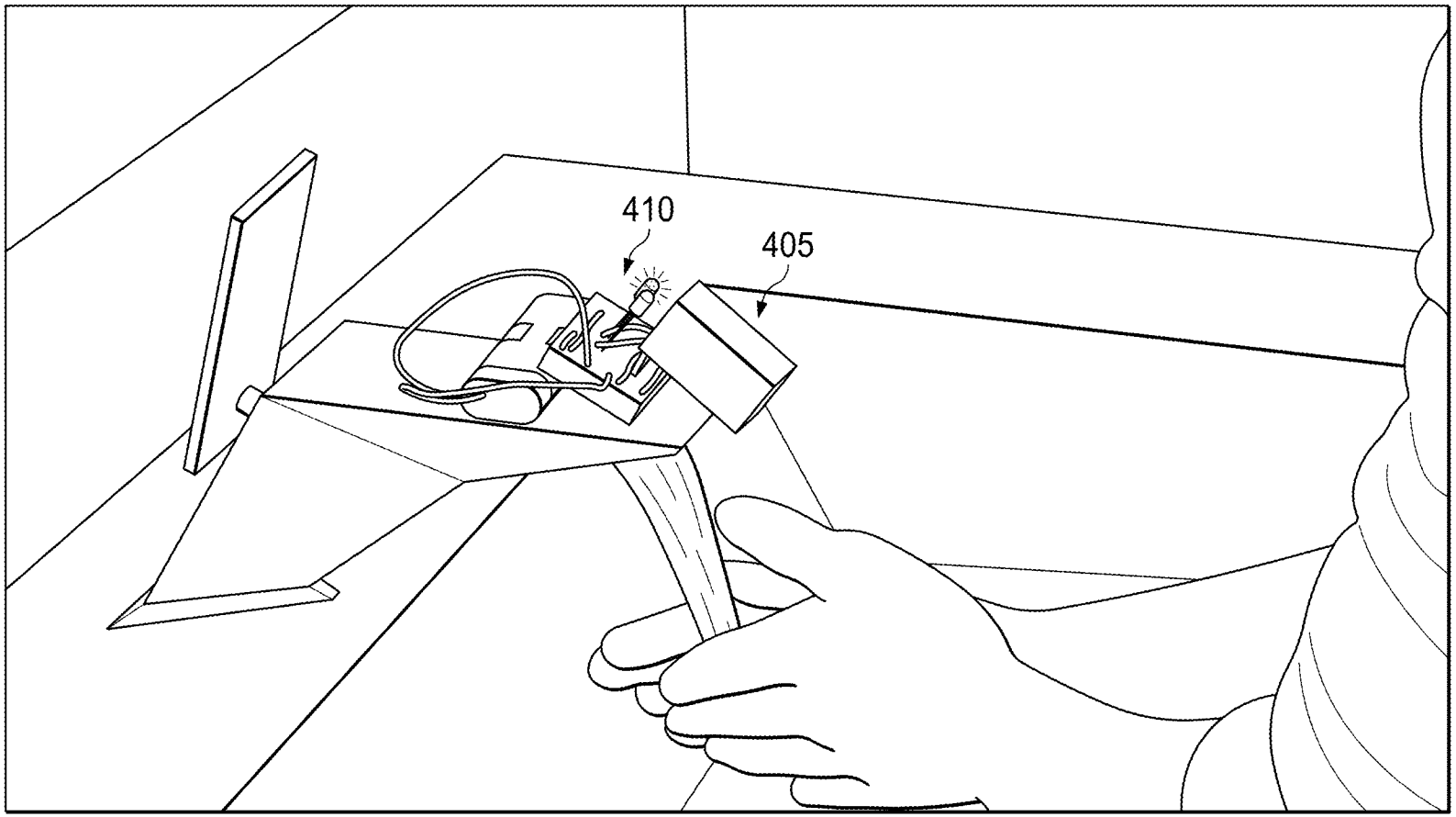

FIGS. 4A-4B are photographs showing the example use of an example system for identifying proper handwashing (e.g., 405). As shown in the progression illustrated in the example of FIGS. 4A-4B, a subject approaches a sink to wash their hands. When they begin rubbing their hands, the device 405 begins flashing a visual indicator 410 to let the user know that they should not stop washing their hands yet (as shown in FIG. 4A). When 20 seconds have passed, a green light (or other indicator) flashes (e.g., as shown in FIG. 4B) to alert the user that they have sufficiently washed their hands.

In some implementations, the improved system may interface (e.g., through a wireless or wired network connection) with one or more other computing systems (e.g., locally or in the cloud), for instance, to send data documenting hand washing events, to collect training data to further improve audio models used by the system, among other example uses. Software applications may be provided on the improved system (e.g., at the sink) or at other (e.g., backend) computing systems to utilize data generated using the improved system and may be implemented in hardware, firmware, and/or software on a single or a distributed collection of machines, among other example implementations.

Figure 5:
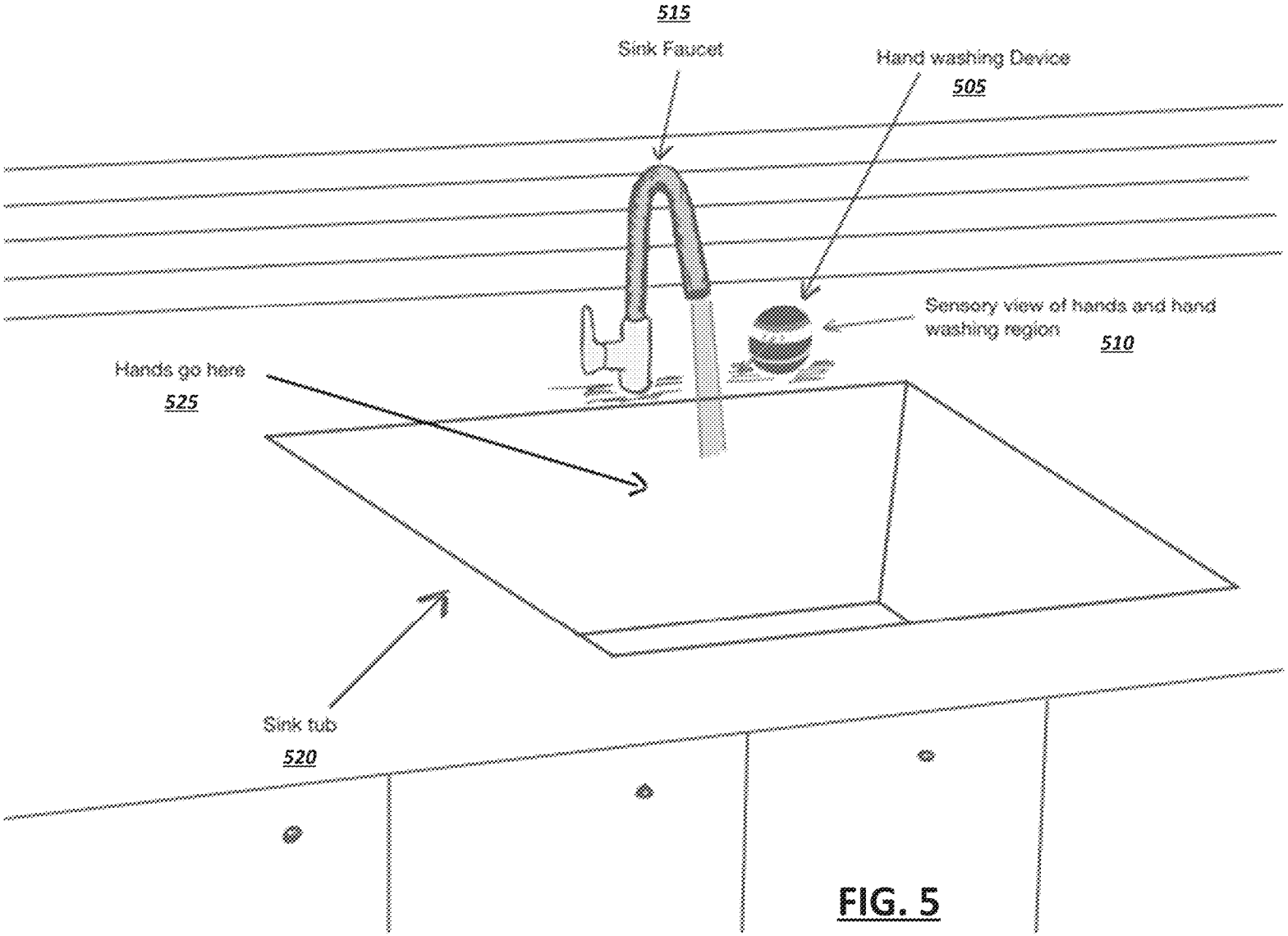
FIG. 5 is a schematic showing another example implementation of a system for identifying proper handwashing in accordance with at least one embodiment.

In one example implementation, a device may be provided, which includes the sensors, logic circuitry, firmware, and/or software to implement all or a portion of an example handwashing monitor system, such as discussed in the examples above. For instance, as illustrated in the diagram of FIG. 5, a handwashing monitor device (or "handwashing device") 505 may incorporate all or a portion of an improved system for identifying proper handwashing and may be mounted on or near a faucet 515 at a sink 520 configured to allow handwashing or other washing. The handwashing device 505 may be mounted in a variety of positions, so long as it maintains a sensory view or range (510) of the handwashing region 525 in the sink, as well as the sounds generated from the act of handwashing. Such a device may incorporate the data processing unit and logic (e.g., for handwashing event detection and sensor data collection and/or sensor fusion), one or more of the sensors generating sensor data for processing by the processing unit, and user interface elements (e.g., visual and/or audio) to present feedback to the user, among other example implementations.

Figure 6A:
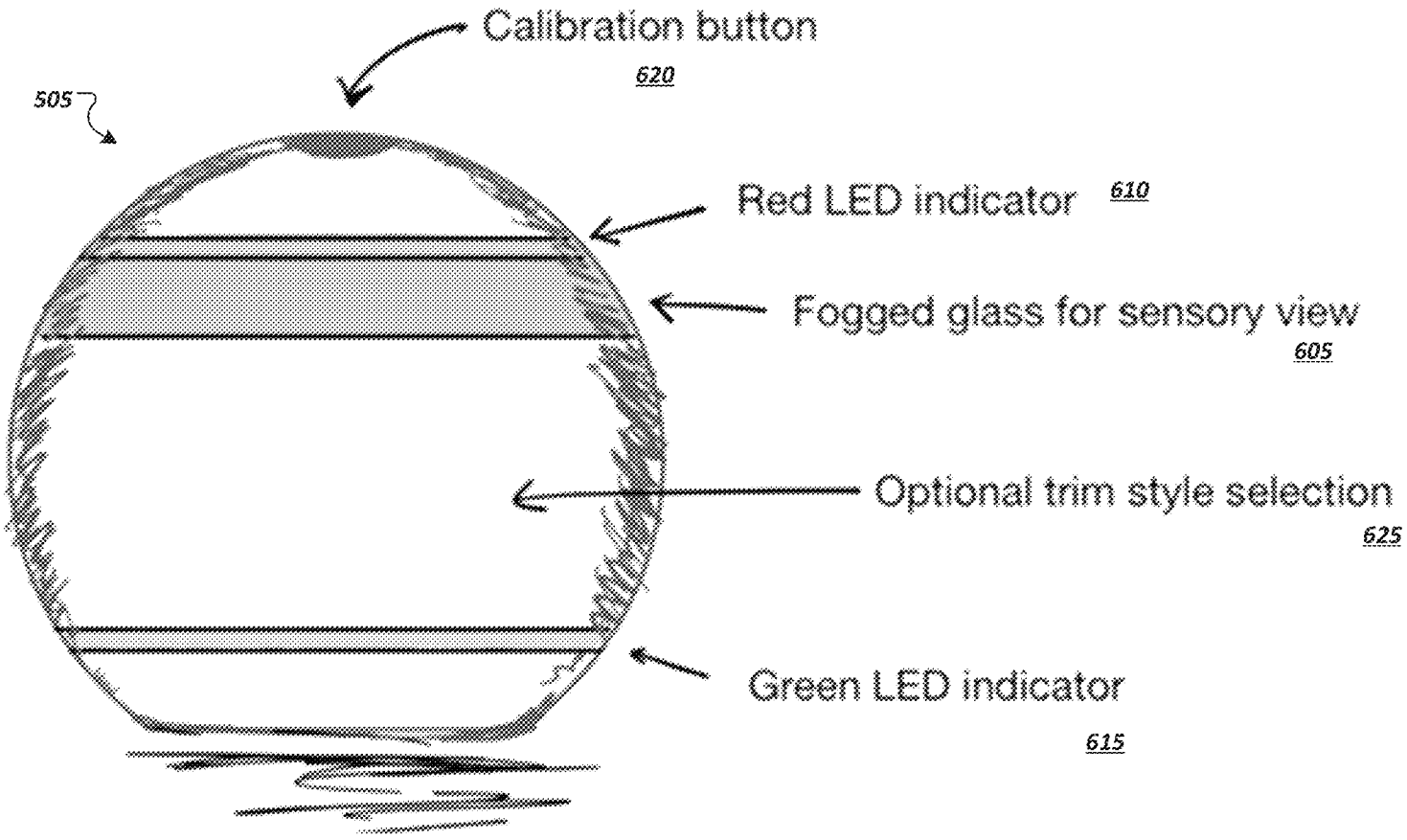
FIG. 6A is a schematic showing an example device implementing an example system for identifying proper handwashing in accordance with at least one embodiment.
Figure 6B:
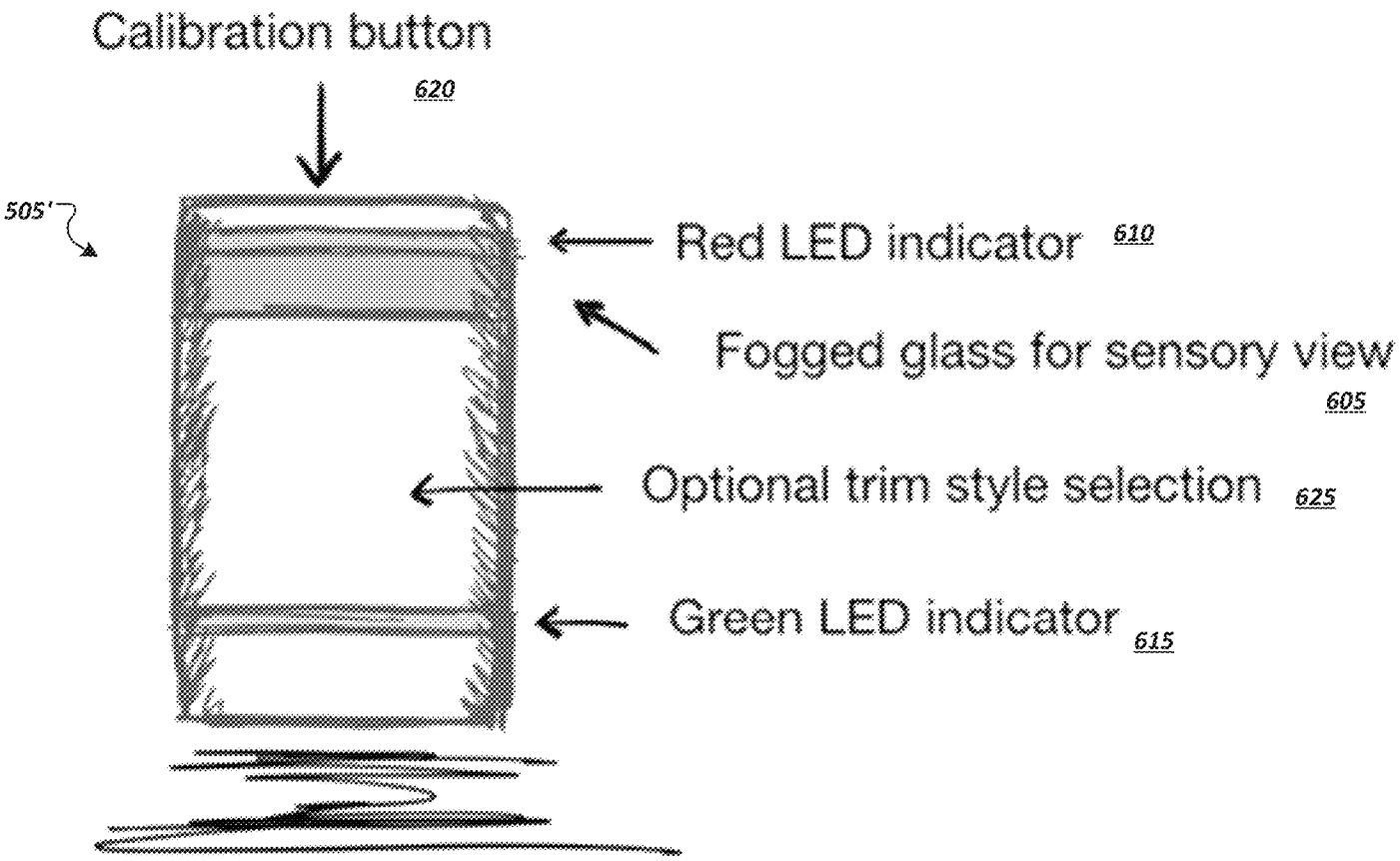
FIG. 6B is a schematic showing of another example device implementing an example system for identifying proper handwashing in accordance with at least one embodiment.

FIGS. 6A and 6B are example designs of an example handwashing device 505. For instance, FIGS. 6A-6B depict a standalone (e.g., separate from the installed faucet and/or sink, which may be offered as an enhancement or retrofitting of a sink) handwashing device, which may additionally serve as a design piece to be placed adjacent to or near the sink's faucet. FIGS. 6A-6B further depict example system sub-components implemented within the handwashing device, which may cooperatively function to implement the features and functionality of a handwashing monitoring system, such as discussed above, among other example subcomponents, subsystems, and related functionality.

In some implementations, such as in the examples of FIGS. 6A and 6B, a handwashing device (e.g., 505, 505') may possess an exterior design 625 and layout that includes a transparent or semi-transparent section 605 (e.g., with fogged or tinted semi-transparent material) allowing for the system's visual sensors to carry out detection purposes from the inside. The fogged layer may extend around the circumference of the spherical shape and cylindrical shape, respectively. The handwashing device may additionally possess microphones or other audio sensors (e.g., which may be effectively hidden from view of users), among other sensors.

The handwashing device may also incorporate the user interface (e.g., red and green LED indicators (e.g., 610, 615) or other visual or audio indicators) to alert a user washing their hands of whether their handwashing efforts have been judged to be sufficient or not. Additionally, a user interface may be presented either physically on the device (e.g., a calibration device) and/or wirelessly (e.g., via an app on a smartphone or other mobile computing device, which connects wirelessly to the handwashing device (e.g., using a WiFi, ZigBee, Bluetooth, or other connection)) to allow an installer, vendor, maintenance professional, or other user to configure and/or train the handwashing device to correctly operate at the particular sink-faucet combination. For instance, in the examples of FIGS. 6A-6B, on the top of the device, a calibration button 620 may be provided to be used for calibrating the device initially to not record false readings from the visual and auditory sensors. For example, a certain range of sound waves accounts for the distinct auditory patterns consistent with hand-rubbing. The calibration button factors in different water pressures and sink tub depths to achieve the most accurate readings for its particular environment and installation, so as not to generate false results (e.g., based on a simple, generic water flow). A variety of button press combinations, voice commands, supplemental wireless computing commands, and other interactions with the handwashing device may be utilized to perform the initialization, configuration, training, and launch of the handwashing device. Such configuration interfaces may be later used to retrain or reconfigure the handwashing device, should a malfunction or change to the sink environment occur, among other examples and implementations.

Figure 7A:
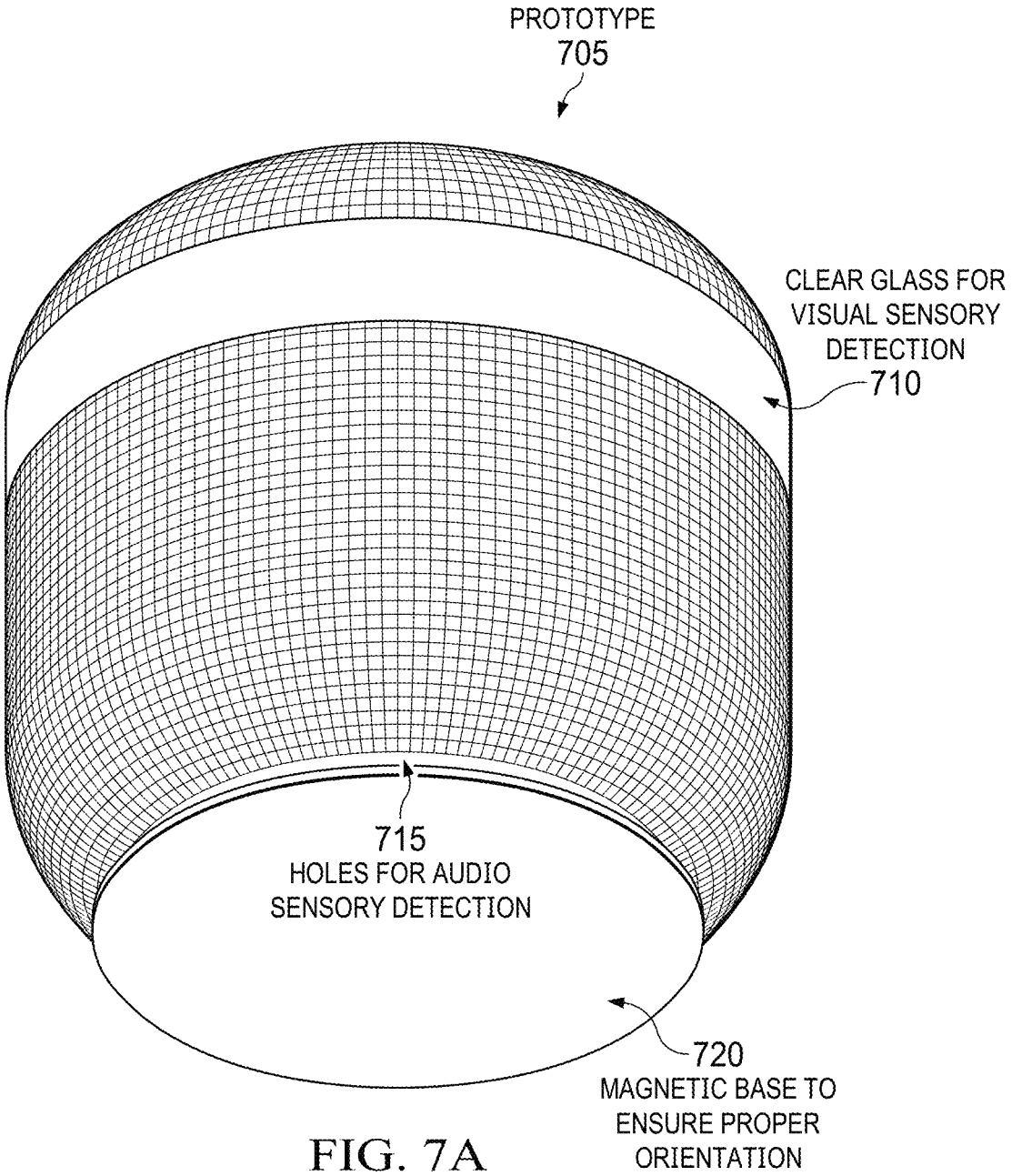
FIGS. 7A-7B are photographs showing another example implementation of a system for identifying proper handwashing in accordance with at least one embodiment.
Figure 7B:
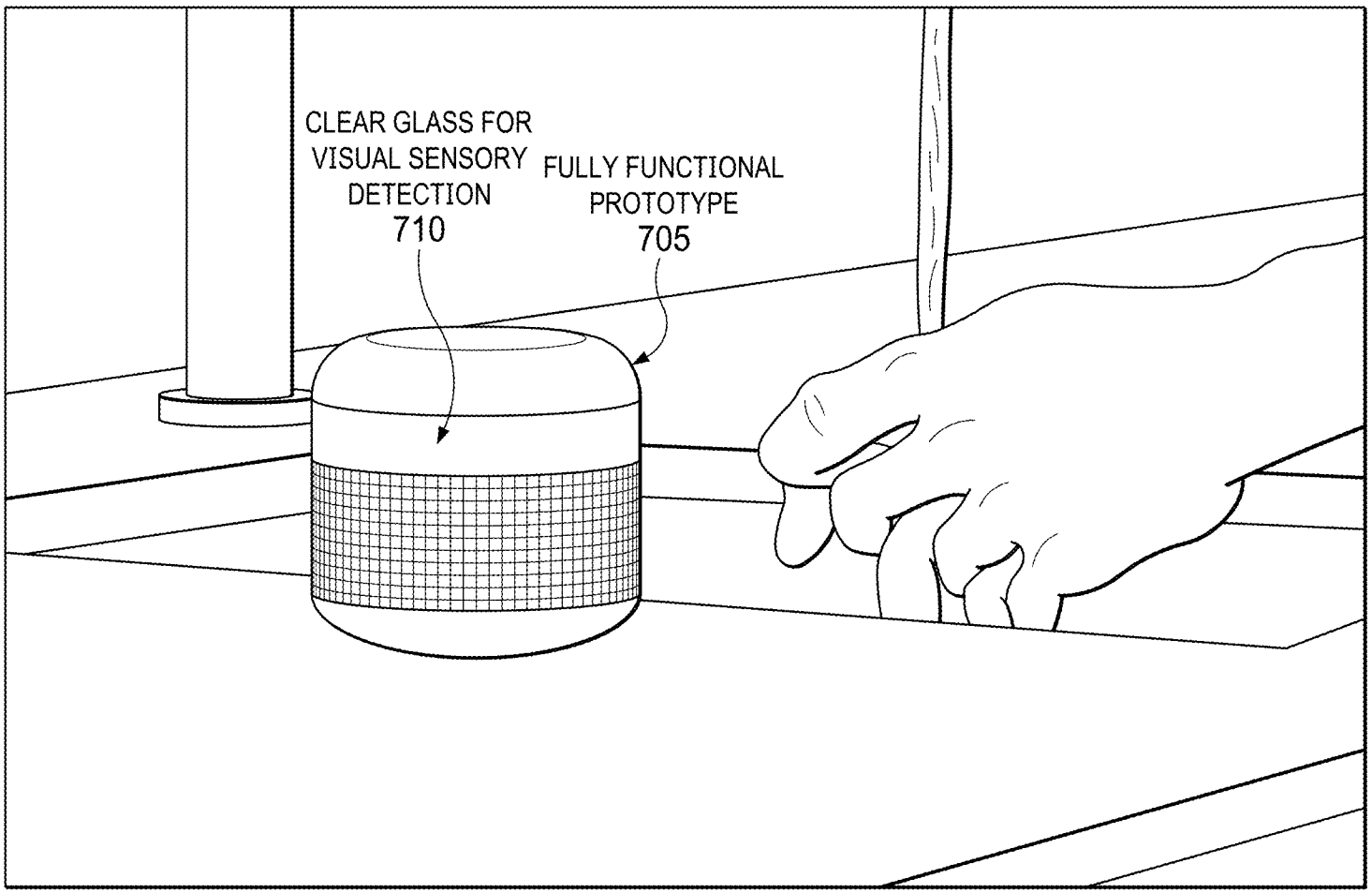

FIGS. 7A-7B are photographs showing another example implementation and design for a system for identifying proper handwashing. For instance, the system may be implemented in a handwashing monitoring device 705 equipped with audio waveform processing and comparison hardware to identify similarities between audio captured by the device 705 (e.g., through holes 715 for audio sensory detection (via an integrated microphone)) and reference audio waveforms characteristics of particular expected handwashing activities to be monitored by the device. A window 710 (e.g., of clear or semi-transparent glass or plastic) may be provided through which visual sensory detection may be facilitated (e.g., PIR, camera, or other visual sensing) and this information may be used together with the audio sensor data to determine handwashing activity and/or the identity of a user participating in handwashing at a nearby sink. As the sensors (e.g., audio and visual) may be configured (and calibrated) to capture directional audio and visual cues, proper orientation of the device 705 may be required in some implementation to enable optimum performance. For instance, in some implementations, a magnetic base 720 may be provided to ensure proper physical orientation (e.g., pointing toward the faucet spout in a sink) of the device. The photograph in FIG. 7B shows an example installation and use of the example handwashing monitoring device 705 shown in the photograph of FIG. 7A.

Figure 8:
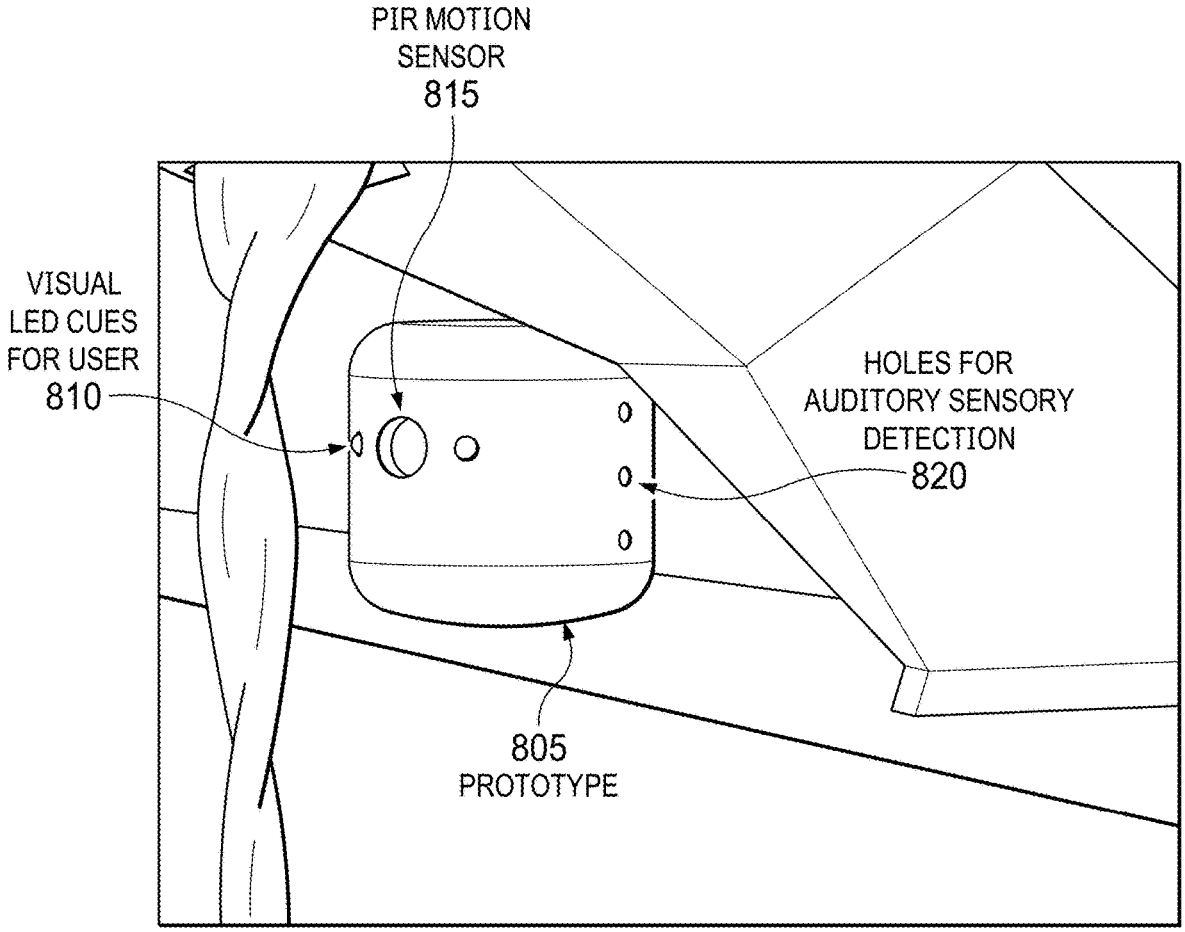
FIG. 8 is a photograph showing another example implementation of a system for identifying proper handwashing in accordance with at least one embodiment.

FIG. 8 is a photograph showing another example implementation of an example handwashing monitoring device 805 design, in this case shown installed at a sink. For instance, LED lights 810 may be provided to show cues or feedback to a user to indicate that the device is actively monitoring a handwashing event and to identify whether the device has detected a successful or unsuccessful handwashing event, among other example outputs. In this implementation, a PIR motion sensor 815 may be provided to identify the proximity of a user at a sink and initiate auditory monitoring at the sink (e.g., using a microphone positioned between openings 820 on the device 805), as well as capture proximity or movement information corresponding to handwashing events that may be used (e.g., together with captured audio data) to determine whether the handwashing event was properly performed as one of a sequence of events in a proper handwashing. As in other examples, the microphone may capture audio waveforms resulting from handwashing activity and detect the successful (or unsuccessful) performance of a sequence of discrete handwashing steps (e.g., in one of one or more defined acceptable handwashing sequences) and present or generate information to illustrate the results of the monitoring.

The flowcharts and block diagrams in the Figures illustrate the architecture, functionality, algorithms, and operation of possible implementations of systems, methods and computer program products according to various aspects of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular aspects only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of any means or step plus function elements in the claims below are intended to include any disclosed structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The aspects of the disclosure herein were chosen and described in order to best explain the principles of the disclosure and the practical application, and to enable others of ordinary skill in the art to understand the disclosure with various modifications as are suited to the particular use contemplated.

The invention claimed is:

1. An apparatus comprising:

a handwashing sensor device comprising:

a housing comprising:

a surface mount to mount the handwashing sensor device to a surface corresponding to a top of a sink; and a window corresponding to an outer perimeter of the housing; and one or more audio sensors within the housing to monitor audio at the sink;

a presence sensor within the housing to detect motion in front of the sink and activate the one or more audio sensors, wherein the presence sensor is mounted behind the window; and circuitry within the housing to:

receive sensor data from the one or more audio sensors, wherein the sensor data comprise audio data collected during functioning of the sink;

detect that the audio data corresponds to one or more particular handwashing events in a set of handwashing events; and determine whether the particular handwashing event satisfies a condition associated with a standard for proper handwashing; and an indicator mounted to the housing to indicate whether proper handwashing has been completed based on whether the particular handwashing event satisfies the condition, wherein the surface mount is configured to orient the housing to direct the presence sensor and the one or more audio sensors toward a spout of a faucet of the sink.

2. The apparatus of claim 1, further comprising a user interface to identify to a user of the sink whether handwashing has been successfully completed.

3. The apparatus of claim 1, wherein the circuitry detects the particular handwashing event based on a Fourier transform.

4. The apparatus of claim 1, wherein the audio data comprises a waveform corresponding to audio captured at the sink.

5. The apparatus of claim 4, wherein detecting that the audio data corresponds to the particular handwashing event comprises determining a similarity between the waveform and a reference waveform characteristic of performance of the particular handwashing event.

6. The apparatus of claim 1, further comprising a non-audio sensor to detect presence of a user of the sink.

7. The apparatus of claim 1, further comprising an identity sensor to sense an identity associated with a user of the sink.

8. The apparatus of claim 1, wherein the set of handwashing events comprise running water, hand movements of a user in the running water, and lathering of soap by the user at the sink.

9. The apparatus of claim 1, wherein the condition comprises a length of time of the handwashing event.

10. The apparatus of claim 1, wherein the condition comprises an order of the handwashing events in the set of handwashing events.

11. The apparatus of claim 1, wherein the sensor data further comprises non-audio sensor data collected at the sink, and the circuitry is further to:

correlate the non-audio sensor data to the audio data to form a particular signature; and determine whether the particular signature corresponding to a reference signature for the particular handwashing event, wherein determine whether the particular handwashing event satisfies a condition associated with a standard for proper handwashing is based on a similarity between the reference signature and the particular signature.

12. The apparatus of claim 11, wherein the non-audio sensor data comprises proximity data captured by a proximity sensor in the one or more sensors.

13. The apparatus of claim 11, wherein the non-audio sensor data comprises visual data captured by a camera sensor in the one or more sensors.

14. A method comprising:

detect, with a first sensor of a handwashing monitor, that a user is to use a sink;

initiate recording of audio data using a second sensor of the handwashing monitor based on detection of the user at the sink using the first sensor;

receiving audio data from the second sensor as collected during functioning of the sink;

transform the audio data into a waveform using a Fourier transform;

comparing the waveform to a pre-defined reference waveform for the sink to detect that the audio data corresponds to one or more particular handwashing events in a set of handwashing events; and determining whether the particular handwashing event satisfies a condition associated with a standard for proper handwashing.

15. The method of claim 14, wherein the audio data comprises a waveform corresponding to audio captured at the sink.

16. The method of claim 15, wherein detecting that the audio data corresponds to the particular handwashing event comprises determining a similarity between the waveform and a reference waveform characteristic of performance of the particular handwashing event.

17. The method of claim 14, wherein the set of handwashing events comprise running water, hand movements of a user in the running water, and lathering of soap by the user at the sink.

18. The method of claim 14, further comprising receiving data from a sensor positioned at a location other than the sink to provide additional sensor data, wherein determining whether the particular handwashing event satisfies the condition associated with the standard for proper handwashing is further based on the additional sensor data.

19. The method of claim 14, further comprising:

receiving additional sensor data comprising non-audio data;

correlating the additional sensor data with the audio data to form a signature for an event detected at the sink, wherein detecting that the audio data corresponds to one or more particular handwashing events in a set of handwashing events comprises determining whether the signature corresponds to a reference signature of audio data and non-audio data corresponding to performance of the particular handwashing event.

20. A system comprising:

means for detecting, based on data from a first sensor, that a user is to use a sink;

means for initiating recording of audio data using a second sensor of the handwashing monitor based on detection of the user at the sink using the first sensor;

means for receiving audio data from the second sensor as collected during functioning of the sink;

means for transforming the audio data into a waveform using a Fourier transform;

means for comparing the waveform to a pre-defined reference waveform for the sink to detect that the audio data corresponds to one or more particular handwashing events in a set of handwashing events; and means for determining whether the particular handwashing event satisfies a condition associated with a standard for proper handwashing.

* * * * *